US009238240B2

(12) United States Patent
Nuzzo et al.

(10) Patent No.: US 9,238,240 B2
(45) Date of Patent: Jan. 19, 2016

(54) AIRBRUSH

(75) Inventors: Stefania Nuzzo, Paris (FR); Eric Parris, Sannois (FR)

(73) Assignee: L'OREAL, Paris (FR)

( * ) Notice: Subject to any disclaimer, the term of this patent is extended or adjusted under 35 U.S.C. 154(b) by 540 days.

(21) Appl. No.: 13/637,556

(22) PCT Filed: Mar. 30, 2011

(86) PCT No.: PCT/IB2011/051350

§ 371 (c)(1),
(2), (4) Date: Nov. 28, 2012

(87) PCT Pub. No.: WO2011/121552

PCT Pub. Date: Oct. 6, 2011

(65) Prior Publication Data

US 2013/0068858 A1 Mar. 21, 2013

Related U.S. Application Data

(60) Provisional application No. 61/324,317, filed on Apr. 15, 2010.

(30) Foreign Application Priority Data

Mar. 30, 2010 (FR) ..... 10 52340

(51) Int. Cl.

| | |
|---|---|
| ***B05B 11/00*** | (2006.01) |
| ***B05B 7/24*** | (2006.01) |
| *B05B 15/00* | (2006.01) |

(52) U.S. Cl.

CPC ..... *B05B 11/00* (2013.01); *B05B 7/2408* (2013.01); *B05B 7/2478* (2013.01); *B05B 15/00* (2013.01)

(58) Field of Classification Search

USPC ..... 118/300; 239/398, 302, 342, 344, 369, 239/376, 327, 372, 569, 525, 526, 309, 310, 239/311, 375, 378

See application file for complete search history.

(56) References Cited

U.S. PATENT DOCUMENTS

| | | | |
|---|---|---|---|
| 1,638,550 | A | 8/1927 | Paasche |
| 1,703,219 | A | 2/1929 | Wold |

(Continued)

FOREIGN PATENT DOCUMENTS

| | | | |
|---|---|---|---|
| DE | 10 2007 048 440 | B3 | 4/2009 |
| EP | 0 492 333 | A1 | 7/1992 |

(Continued)

OTHER PUBLICATIONS

Sep. 20, 2011 International Search Report and Written Opinion issued in International Patent Application No. PCT/IB2011/051349.

(Continued)

*Primary Examiner* — Justin Jonaitis
(74) *Attorney, Agent, or Firm* — Oliff PLC

(57) ABSTRACT

A junction device for a spray system. The device is arranged so as to connect, to an airbrush, at least one removable container containing a composition for spraying, the device includes at least a composition-outlet first orifice enabling the composition to leave the container in order to be sprayed via the airbrush, and at least an air-inlet second orifice enabling air intake by the container, the device including an air-intake channel that is connected to the air-inlet orifice, and said channel terminating by an air-entry orifice that is situated above the air-inlet orifice and the composition-outlet orifice.

23 Claims, 4 Drawing Sheets

(56) References Cited

U.S. PATENT DOCUMENTS

| | | | | |
|---|---|---|---|---|
| 2,057,434 | A | 10/1936 | Jaden et al. | |
| 2,550,404 | A * | 4/1951 | Chasan et al. | 239/346 |
| 2,868,585 | A * | 1/1959 | Esser | 239/366 |
| 2,999,646 | A * | 9/1961 | Wagner | 239/332 |
| 3,060,956 | A * | 10/1962 | Menzie | 137/205.5 |
| 3,191,869 | A | 6/1965 | Gilmour | |
| 4,623,095 | A * | 11/1986 | Pronk | 239/311 |
| 5,086,978 | A * | 2/1992 | Fertig | 239/305 |
| 5,253,900 | A * | 10/1993 | Snyder | 285/12 |
| 5,433,191 | A | 7/1995 | Haber et al. | |
| 6,341,736 | B1 * | 1/2002 | Liao | 239/375 |
| 6,345,773 | B1 | 2/2002 | Shanklin et al. | |
| 6,386,392 | B1 | 5/2002 | Argentieri et al. | |
| 6,971,589 | B2 * | 12/2005 | Incardona et al. | 239/272 |
| 7,861,951 | B2 * | 1/2011 | Juo | 239/354 |
| 2006/0278661 | A1 * | 12/2006 | Cooper et al. | 222/321.1 |
| 2007/0018016 | A1 | 1/2007 | Yechouron | |
| 2007/0090206 | A1 | 4/2007 | Barch et al. | |
| 2009/0014474 | A1 * | 1/2009 | Kennedy et al. | 222/372 |
| 2009/0090297 | A1 | 4/2009 | Kitajima | |

FOREIGN PATENT DOCUMENTS

| | | | |
|---|---|---|---|
| EP | 0 678 334 | A2 | 10/1995 |
| EP | 1 470 867 | A2 | 10/2004 |
| EP | 1 598 117 | A1 | 11/2005 |

OTHER PUBLICATIONS

Sep. 20, 2011 International Search Report and Written Opinion issued in International Patent Application No. PCT/IB2011/051350.
Nov. 19, 2010 Preliminary Search Report issued in French Patent Application No. 1052345 (with translation).
Nov. 25, 2010 Preliminary Search Report issued in French Patent Application No. 1052340 (with translation).
U.S. Appl. No. 13/637,504 filed Dec. 4, 2012.
May 22, 2015 Non-Final Rejection issued in U.S. Appl. No. 13/637,504.

* cited by examiner

AIRBRUSH

TECHNICAL FIELD

The present invention relates to spray devices using a vector gas, also known as airbrushes. Amongst applications for the human body, mention may be made of applying a care product or makeup to the face or the body, in particular the scalp or the hair.

BACKGROUND

Conventional airbrushes comprise a body that may be in the general shape of a pistol or a pen, on top of which a cup is sometimes provided, into which the composition for spraying is poured. Such airbrushes are known as "gravity" airbrushes.

The cup may be fitted with a stopper or with a hinged lid that the user puts back into place after filling the cup with the composition for spraying.

The presence of a single cup fastened on the body of the airbrush, and into which the composition is poured, results in numerous manipulations while filling and cleaning the airbrush, that are often accompanied by composition being wasted. Such manipulations are also troublesome when using a composition that requires avoiding contact with the environment, such as a composition that is sensitive to air or that is an irritant.

"Suction feed" airbrushes also exist in which the composition is contained in a container that, after being filled, is coupled, with its neck directed upwards, to the body of the airbrush, the airbrush including a dip tube that extends to the bottom of the container. As with the gravity versions, the suction versions result in tricky manipulations in order to clean the container between two uses. In addition, the ergonomics of such airbrushes is not as good as the ergonomics of cup airbrushes, since the presence of the dip tube is likely to hinder the user in some situations, e.g. when the airbrush is to be manipulated around the face or the head of a person, for example. Furthermore, suction feed airbrushes have an extraction rate that is insufficient.

U.S. Pat. Nos. 1,638,550, 1,703,219, 6,345,773, 2,057,434, and 3,191,869 relate to suction feed airbrushes. European patent application EP 0 492 333 relates to a closure system for closing a sprayable-liquid container that is provided with a dip tube for sucking up the liquid. US application No. 2009/0090297 gives examples of suction and gravity airbrushes.

Application EP 1 598 117 relates to an adapter for a spray gun including an expandable reservoir, and application EP 0 678 334 discloses a spray gun that operates by sucking up paint contained in a discardable flexible pouch. Such devices are adapted to very particular containers.

Application EP 1 470 867 A2 describes an airbrush in which the composition for spraying is contained in a container that is suitable for being fastened in removable manner on the body of the airbrush. The container is provided with a valve that closes when the container is not in place, and that opens after the container has been fastened on the airbrush. Although the use of a valve presents advantages by reducing the exposure of the composition to the environment, it results in the container being constructed in a specific manner that increases its cost. In addition, while drying or because of a particulate filler, some compositions are likely to prevent the valve from operating properly, e.g. by causing said valve to jam in its closed or open position.

US application No. 2007/0090206 A1 discloses an airbrush including a housing for receiving a container that is fastened in removable manner on the airbrush. The container includes a valve, thereby posing the same problem as mentioned above. In the airbrush disclosed in that publication, air is taken in on the same side as the side via which the composition is entrained into the airbrush, via a capillary passage that is formed along an endpiece that is configured to act on the valve and that comes to be engaged in the opening of the container.

Patent DE 10 2007 048 440 relates to a lid for connecting a spray gun to the composition outlet of a paint container. A labyrinth-forming gasket guides the outside air to the bottom of the container.

US application No. 2007/0018016 describes an assembly for spraying a liquid, the assembly including a removable container including an air-intake channel having an air-entry end that is situated below the air-inlet in the container.

There exists a need to improve airbrushes still further, while benefiting from good ergonomics and reliability in operation.

BRIEF DESCRIPTION OF THE DRAWINGS

The invention can be better understood on reading the following detailed description of non-limiting embodiments thereof, and on examining the accompanying drawings, in which.

DETAILED DESCRIPTION

Figure 1:
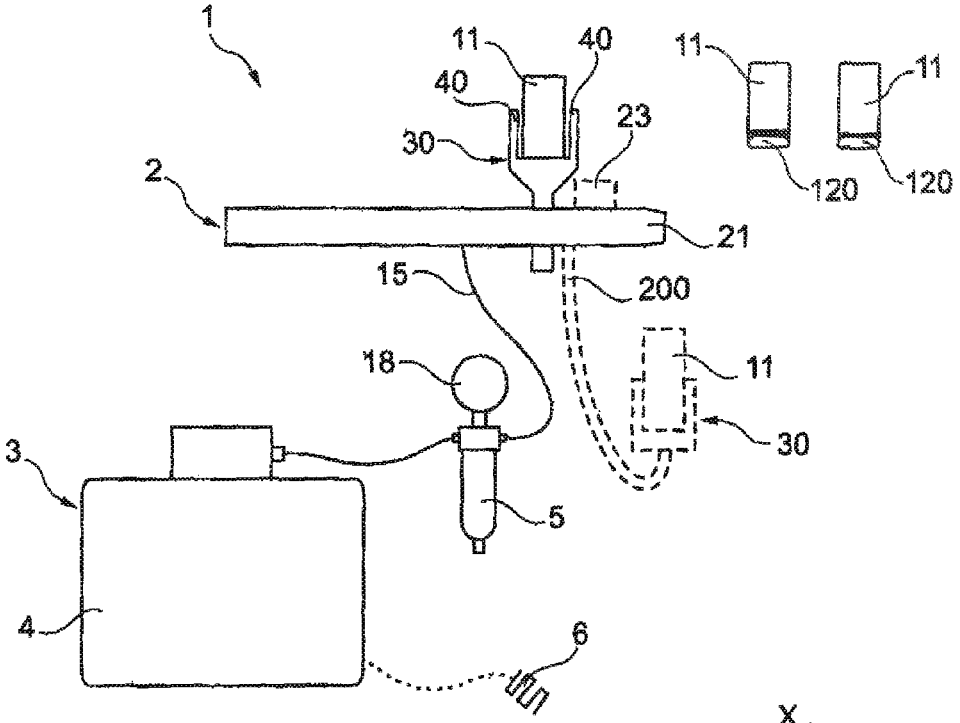
FIG. 1 is a diagrammatic and fragmentary view showing an airbrush and an example of a system for supplying the airbrush with compressed air.
Figure 3:
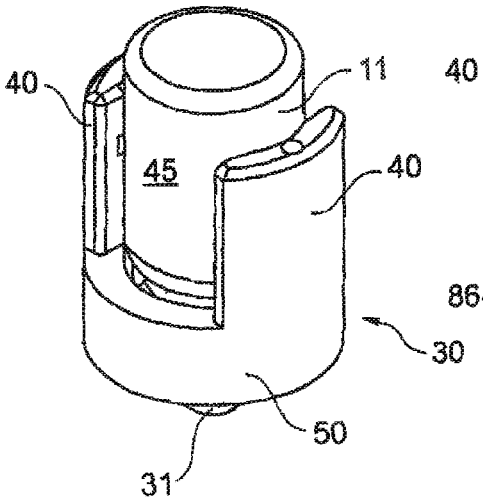
FIG. 3 shows the FIG. 2 junction device after the container has been put into place.
Figure 2:
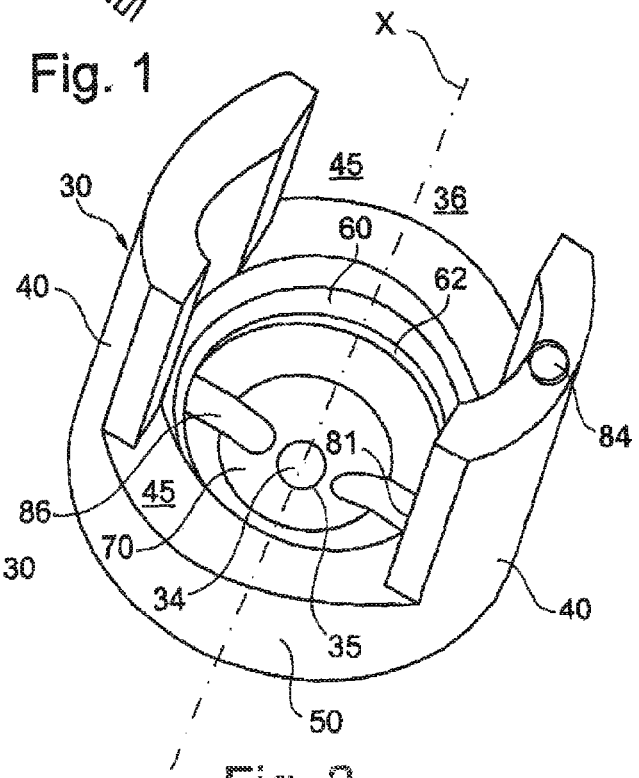
FIG. 2 is a perspective view showing, in isolation, the junction device that is used to receive the container.
Figure 4:
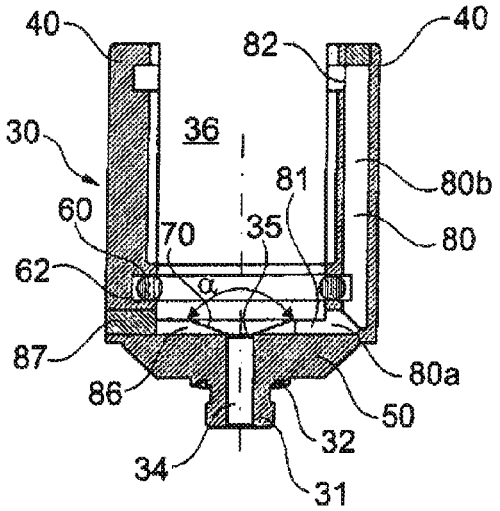
FIG. 4 is a longitudinal section of the junction device with the container removed.

Exemplary embodiments of the invention provide a junction device for a spray system, said device being arranged so as to connect, to an airbrush, at least one removable container containing a composition for spraying, the device comprising:

- at least a composition-outlet first orifice enabling the composition to leave the container in order to be sprayed via the airbrush; and
- at least an air-inlet second orifice in the container enabling air intake by the container, the device including an air-intake channel that is connected to the air-inlet orifice, and said channel terminating by an air-entry orifice that is situated above the air-inlet orifice and the composition-outlet orifice during use.

In other exemplary embodiments the invention also provides a spray system comprising such a junction device and an airbrush, the spray system preferably being associated with one or more removable and interchangeable containers, each containing a composition for spraying, said container(s) being for fastening on the assembly comprising the airbrush and the junction device.

The relative positions "above", "below", "top", and "level" refer to a state of the airbrush, of the junction device, and/or of the container from which the composition may flow by gravity towards the inlet of the airbrush.

Once the container is fastened on the airbrush, the air-entry orifice is preferably situated above the maximum level of composition for spraying, and said composition may flow downwards.

The invention presents numerous advantages.

Firstly, the fact that the air-entry orifice is situated above the air-inlet orifice makes it possible for the air-intake circuit to avoid using a valve that opens in the event of suction in the container, and to avoid the drawbacks associated with the use of such a valve in terms of cost of manufacture and of reliability in operation. This is particularly true when the air-entry orifice is situated above the maximum level of composition for spraying. Thus, the air-intake circuit need not have any valve. In addition, the air-intake channel may have a section that is relatively large, thereby reducing the risk of accidental blockages. By way of example, the air-intake channel may present a section lying in the range 0.1 square millimeters ($mm^2$) to 10 $mm^2$.

The air-intake channel is other than a mere air entry due to clearance between the container and the junction device. The length of the air-intake channel is a function of the maximum depth, in the container, of the composition for spraying. In particular, it may lie in the range 5 millimeters (mm) to 500 mm.

The fact that the air-entry orifice is situated above the air-inlet orifice also makes it possible to avoid the composition leaving too easily via the air-intake channel, in particular when little composition remains in the container and when the airbrush is manipulated vigorously, or during the removal of the container when a residual quantity of composition is present at the air inlet.

The invention makes it possible to use containers that do not have valves or vents other than their main openings, and, in particular, containers that are bottles that may also be used by pouring their contents directly onto the surfaces to be treated, or onto an intermediate surface that is used for application to the surfaces to be treated. The invention makes it possible to avoid manufacturing containers that are specifically for use on the airbrush. In particular, the invention does not need to use a container that is flexible and leaktight. Amongst bottles that are currently used and that are suitable for the present invention, mention may be made of bottles made of rigid or semi-rigid material, e.g. made of glass or thermoplastic material, this list not being limiting.

Preferably, the device is used with a gravity airbrush. The device may equally well be used with a suction feed airbrush, the junction device may thus include communication means, e.g. a tube, making it possible to put the composition-outlet first orifice into communication with the inlet of the airbrush, thereby enabling suction.

The container may initially be closed when it is made available to the user, containing the composition for spraying. Preferably, it is closed.

The container need not have any valve. The container may include one or more openings that are preferably all closed, before the container is used on the airbrush, by any usual closure means, e.g. stopper(s), cap(s), top(s), lid(s), teat(s), . . . .

After fastening on the airbrush, the container does not present any openings that are directly in contact with the outside air. The space inside the container is in contact with the outside air only via the air-intake channel.

The container may be put into place on the airbrush with its opening initially directed upwards.

Thus, either the junction device is fastened on the container, then the container and junction device assembly are turned over so as to fasten it on the airbrush, or the junction device is fastened on the airbrush and the airbrush and junction device assembly are turned over for fastening on the container. In use, the container is upsidedown with its bottom on top.

During operation of the airbrush, the composition for spraying flows from top to bottom in the container. In the event of using only a fraction of the composition contained in the container, the airbrush may be turned over once again, and the container removed, then re-closed, so as to be ready for subsequent use. However, it is preferable for the container to be of a size such that its contents are dispensed in a single use, so as to reduce the number of manipulations.

By way of example, the container is in the form of a bottle that is provided with a neck that is provided with a collar.

The composition-outlet orifice of the junction device may be a mere orifice that opens out facing the opening of the container for example, preferably in centered manner. However, the composition-outlet orifice may be offset relative to the axis of the opening of the container. A centered outlet orifice may enable a slope to be made that encourages the composition to flow.

By way of example, the section of the composition-outlet orifice may lie in the range 0.1 $mm^2$ to 1 square centimeter ($cm^2$), its shape preferably being circular.

By way of example, the section of the air-inlet orifice may lie in the range 0.1 $mm^2$ to 1 $cm^2$, its shape preferably being circular.

By way of example, the section of the air-entry orifice may lie in the range 0.1 $mm^2$ to 1 $cm^2$, its shape preferably being circular.

The junction device may define a housing in which the container is engaged, at least in part, when the device is in place on the airbrush.

The junction device may thus surround the container, at least in part, and may contribute to holding it on the airbrush.

The housing may be upwardly open.

The junction device may include a housing into which a container may come to be inserted, at least in part.

The bottom of the housing may present a slope that defines a conical section that converges towards the composition-outlet orifice.

The junction device may be entirely outside the container when the container is in place. In other words, the junction device need not include any endpiece or other element that is capable of engaging in an opening of the container when said container is in place. This makes it easier to construct the airbrush and the container.

The air-inlet orifice may be situated lower than the container.

The air-inlet orifice may be oriented perpendicularly to the longitudinal axis of the container, which may in particular make it easier to construct the junction device, e.g. by making it easier to mold and/or to machine said junction device.

The air-entry orifice may be situated below the top level of the container, once said container is fastened on the junction device, which is itself fastened or connected to the airbrush.

Preferably, the air-entry orifice is situated above the maximum composition level in the container.

By way of example, the air-entry orifice may be situated more than 1 cm above the air-inlet orifice, better more than 2 cm above said air-inlet orifice.

The device may include a sealing gasket that provides leaktight fastening of the container on the junction device.

The air-entry orifice may be situated above the sealing gasket.

The air-entry orifice may open out freely upwards. It may also open out facing the container, onto a vertical inside wall of the junction device. This reduces the risk of dirt entering into the air-intake channel, the risk of said air-inlet channel accidentally blocking, and the risk of composition leaking onto the body of the airbrush or onto the user.

The junction device may include one or more uprights that preferably do not surround the container completely over its entire height. This makes it possible to form one or more grip zones for gripping the container, making it easier to remove the container and to put it into place. The air-inlet channel may be situated, over at least a fraction of its length, in the thickness of an upright, thereby improving the appearance of the airbrush, e.g. since the air-intake channel is not visible to the user once the container is in place.

The air-entry orifice may open out facing the container when said container is in place on the airbrush.

The composition-outlet orifice may be disposed coaxially about the longitudinal axis of the container.

The inlet of composition into the airbrush via the composition-outlet orifice of the junction device may be performed coaxially about the longitudinal axis of the container, and that may make it easier for the fluid to flow.

At its base, the junction device may include a slope that defines a conical section, making it easier for the composition to flow towards the inlet of the airbrush, and enabling the container (and any cavity formed between the container and the junction device) to be emptied properly.

The fastening of the container on the junction device may be sealed in various ways.

In exemplary embodiments of the invention, the junction device includes a gasket, preferably an O-ring. The gasket is disposed so as to be able to snap-fasten on the container, possibly on a collar of the container, and so as to bear in leaktight manner against the container. Such a gasket thus provides two functions of sealing and of fastening, and makes it possible to have an airbrush of relatively simple construction.

The junction device may be fastened on the body of the airbrush in optionally-removable manner, or it may be incorporated in the body of the airbrush and constitute a portion thereof.

The junction device may include a fastener endpiece for fastening on the body of the airbrush. At its endpiece, the junction device may include sealing means, such as an annular gasket for example, enabling the junction device to be fastened in leaktight manner on the body of the airbrush. The junction device may be snap-fastened, screw-fastened, heat-sealed, adhesively-bonded, or fastened in some other way on the airbrush that is for example a commercially-available airbrush in which the usual cup has been replaced by a junction device of the invention. In exemplary embodiments, it is possible to make the junction device in the form of a portion of the body of the airbrush, the junction device thus not necessarily projecting relative to the body of the airbrush.

The junction device may include perforator means that are arranged to perforate the container while said container is being put into place. In these variant exemplary embodiments, only the container need be turned upsidedown and put directly into place on the junction device, without any need for either the airbrush or the junction device to be turned upsidedown.

The perforator means may perforate closure means of the container while said container is being put into place on the junction device.

The perforator means are hollow and respectively include a composition-outlet orifice enabling the composition to be taken, and an air-inlet orifice enabling air intake.

The perforator means may comprise at least two needles, e.g. parallel needles.

In other exemplary embodiments, and independently or in combination with the above, the invention also provides an airbrush system comprising:

an airbrush;

a junction device including at least one housing for receiving at least one container containing at least one composition for spraying, and being in the form of a bottle, possibly with a neck provided with a collar; and an annular gasket that is disposed so as to snap-fasten on the bottle, and in particular on the collar if one is present, when the container is in place, and so as to bear in leaktight manner on the container.

Such a gasket provides a reliable and technically simple solution to the problem of fastening the container on the airbrush. The gasket may be received in an annular groove, e.g. a groove made in the base of the above-mentioned junction device.

The airbrush system may also include at least one removable container containing a composition for spraying, and preferably being in the form of a bottle, with a neck provided with a collar. The airbrush may be a suction feed airbrush, and the junction device may be provided with a communication system, e.g. a tube, between the composition-outlet orifice and the inlet of the airbrush, thereby enabling suction.

In a variant, the airbrush may be a gravity airbrush.

Other exemplary embodiments of the invention also provide a spraying method comprising spraying a composition by means of an airbrush system of the invention, the composition being: art paint or industrial paint, in particular for buildings, automobiles, aircraft, bicycles and motorbikes, shipbuilding; or a composition for treating wood; or an industrial cleaning composition, e.g. for cleaning windows; or a dye for textiles; or a food coloring, in particular such as that used in confectionery; or a composition for treating leather; or a cosmetic composition, e.g. for applying to keratinous materials and/or to the mucous membranes, in particular for body painting or tattooing or for applying makeup to the nails or the face.

The invention also provides a method of treating a given surface, in which method one or more compositions are sprayed onto the surface by means of an airbrush system, in accordance with exemplary embodiments of the invention as defined above.

The treatment may be a treatment of human keratinous fibers, e.g. a non-therapeutic cosmetic treatment.

In the context of these methods, the composition for spraying may initially be contained in a container that is closed preferably by valveless closure means, e.g. closure means in the form of a cap or teat that is snap-fastened on a collar of the container.

The invention also provides an airbrush system comprising: an airbrush; a junction device in accordance with exemplary embodiments of the invention; and a plurality of closed and pre-filled interchangeable containers for mounting on the airbrush.

In exemplary embodiments of the invention, a system of the invention may include one or more additional devices enabling the sprayed composition and/or the treated surface to be heated or cooled.

FIG. 1 shows an example of a spray system (also referred to as an airbrush system) of the invention.

As shown, the airbrush system 1 may comprise an airbrush 2 that is connected to a compressed-gas source, e.g. comprising an air compressor 4 that is connected in conventional manner to the airbrush 2 via a pressure regulator 5 and a flexible hose 15. The compressed-gas source may equally well be an interchangeable or rechargeable capsule of compressed gas, e.g. of compressed air.

The operation of the compressor 4 may possibly be controlled by a foot-actuated system 6 or by any other control means, e.g. hand-controlled or voice-controlled means. In variants, the operation of the compressor 4 may equally well be triggered automatically by detecting movement of the airbrush or its removal from a stand.

The compressor 4 preferably emits sound that is quieter than 40 decibels (dB) and preferably provides an air flow that is greater than or equal to 15 liters per minute (L/min), the compressor 4 optionally has an air supply, preferably with thermal protection, and also preferably has an outlet that is fitted with a quick coupler for fastening the connection hose 15 to the airbrush.

The compressor 4 may be a single-piston, dual-piston, dry, or oil-bath compressor, and the pressure regulator 5 is preferably fitted with a pressure gauge 18.

Figure 14:
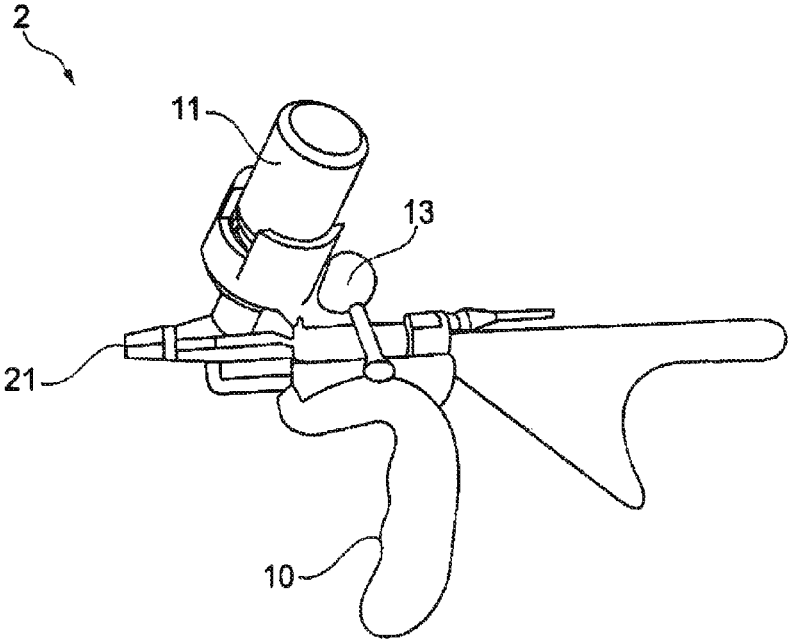
FIG. 14 shows another example of an airbrush.

In known manner, the airbrush 2 includes a handle portion that, by way of example, is defined by the elongate body of the airbrush when said airbrush presents the shape of a pen, or by a handle 10 when said airbrush is of the pistol-grip type, as shown in FIG. 14.

The airbrush 2 may carry a container 11 containing the composition for spraying, the container 11 being in the form of a removable bottle, for example. As shown, the top portion of the airbrush may include a junction device 30 for receiving the container 11.

During operation of the airbrush 2, the composition is sucked up and flows into the airbrush via a composition-taking channel prior to being sprayed.

The container 11 may be transparent or provided with graduations so as to enable the user to see more easily the quantity of composition that is available. By way of example, the volume of composition contained in the container 11 lies in the range 1 milliliter (mL) to 5000 mL, and preferably in the range 1 mL to 1000 mL. Preferably, the flexible hose 15 that connects the airbrush to the compressor 4, and in particular to the air pressure regulator 5, presents a length that is less than or equal to 5 meters (m), and its inside diameter is equal to 4 mm, for example. Preferably, the flexible hose 15 is provided with quick-coupler endpieces.

The airbrush 2 may possibly include a lighting system 23 for illuminating the zone towards which the composition is projected. By way of example, the lighting system 23 comprises one or more light-emitting diodes emitting light that is white or of some other color. Where appropriate, the angle of divergence of the light beam emitted by the light source 23 may be selected so that the illuminated area corresponds substantially to the area touched by the composition when projected from a predefined working distance.

The light source 23 may equally well include a laser pointer making it possible to project a spot of light or a target onto the zone to be treated, making it easier for the user to direct the airbrush 2 in the correct direction. This makes it possible to direct the composition as well as possible, reducing losses due to spraying onto zones at the periphery of the region being treated.

Where appropriate, the projected target appears blurred when the airbrush is not at the correct spraying distance.

The airbrush 2 may be made available to the user with a plurality of pre-filled and closed containers 11, as shown in FIG. 1, e.g. each containing the same composition, so as to enable the user to replace an empty container quickly with a full container, e.g. for treating different people.

The containers 11 may equally well have different contents, e.g. of different composition and/or color, seeking to perform different optionally-complementary treatments, and the user may choose from the containers 11, the container having the composition that corresponds to the treatment that is to be performed.

The spraying parameters, in particular the flowrate of the vector gas (preferably air) and/or the flowrate of sprayed composition, may be adapted manually by the user each time the container 11 is changed, when that is necessary, or during use.

In a variant, the airbrush system 1 is arranged to adapt the operating parameters automatically, as a function of the container 11 that is in place and of the composition that is contained therein, e.g. by means of the airbrush system 1, e.g. the airbrush 2, recognizing which container 11 is being used. By way of example, the reservoirs containers 11 may present identifiers that are recognized by the airbrush system 1. For example, each container may include an electronic chip, an optical code, or portions in relief that are detected by a suitable detector, e.g. present on the airbrush 2, with a processor making it possible to control at least one actuator, so as to change an operating parameter as a function of the information read.

The relative pressure of the compressed air at the inlet to the airbrush 2 may lie in the range 0.2 bar to 3 bar, e.g. being about 0.6 bar.

Preferably, the nozzle 21 equipping the airbrush is selected so that the mean size of the sprayed droplets of composition is centered on a value lying in the range 10 μm to 35 μm, e.g. being about 23 μm (size measured at a distance of 15 cm from the outlet of the nozzle).

Figure 11:
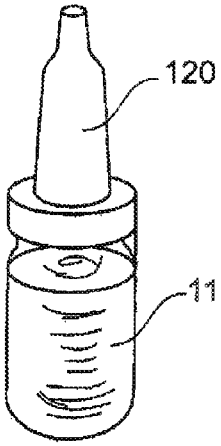
FIGS. 11 and 12 are perspective views showing examples of containers in isolation, before being put into place on the airbrush.
Figure 12:
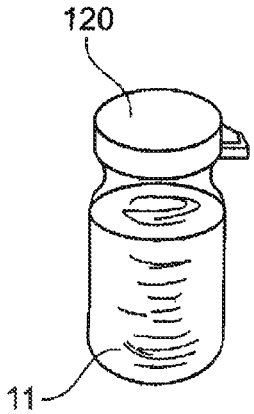

FIGS. 2 to 5 show, in isolation, a first embodiment of the junction device 30 that is suitable for a container 11 that is in the form of a bottle, including a neck provided with a collar 67, and closure means 120, said closure means being as shown in FIGS. 11 and 12, for example.

In the embodiment shown, the junction device 30 includes a fastener endpiece 31, e.g. of the quick-coupler type, for fastening on the body of the airbrush, so as to enable it to be fastened in removable manner on the body of the airbrush.

Naturally, it is not beyond the ambit of the present invention for the junction device 30 to be fastened in non-removable manner on the remainder of the airbrush, or for it to be fastened in removable manner by using means other than a quick coupler.

When the junction device 30 is in place on the airbrush, the axis of the endpiece 31 may be vertical, or it may be oriented obliquely towards the front or the rear of the airbrush.

It is also possible to make the junction device 30 as part of the body of the airbrush, the junction device 30 not necessarily projecting relative to the body of the airbrush.

In the embodiment shown, the junction device 30 includes sealing means, such as an annular gasket 32, enabling the junction device to be fastened in leaktight manner on the airbrush.

In the embodiment under consideration, the junction device 30 includes a composition-taking channel 34 that extends through the endpiece 31. The channel 34 opens out at its top end via a composition-outlet orifice 35, into a housing 36 for receiving the container 11.

The housing 36 is defined by a base 50 and by one or more uprights 40 of the junction device 30 that do not extend all around the container 11, so as to form at least one access zone for accessing the container 11, making it easier to remove the container and to put it into place.

In the embodiment shown, the housing 36 is defined between the base 50 and two diametrally-opposite uprights 40 that form between them two access zones 45 for accessing the container 11.

In the figures, it can also be seen that the height of the uprights 40 is less than the height of the container 11.

In the embodiment under consideration, each upright 40 presents an inside face that is concave facing towards the other upright, and that substantially matches the cylindrical shape of the container 11, but the invention is not limited to any particular shape of upright 40.

The uprights 40 may be made integrally with the base 50 of the junction device 30, as shown, but, in variants that are not shown, the uprights 40 may be fitted on the base 50.

As shown, the base 50 may be made integrally with the endpiece 31 and/or the uprights 40.

In another variant, the junction device 30 may be made out of a plurality of parts, e.g. parts that are interfitted, heat-sealed, adhesively-bonded, or screw-fastened together. In a variant that is not shown, the junction device 30 may equally well include a single tubular upright.

Figure 5:
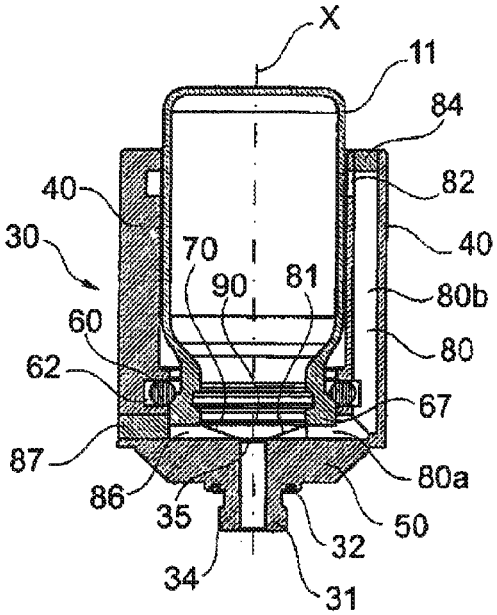
FIG. 5 corresponds to FIG. 4 with the container in place.

By way of example and as shown, the junction device 30 may carry a sealing gasket 60 that is received in an annular groove 62 that is formed in the base 50, the sealing gasket 60 possibly having two functions, namely firstly enabling the collar 67 of the container 11 to be snap-fastened so as to prevent it from moving axially in the housing 36, as shown in FIG. 5, and secondly bearing in leaktight manner on the container so as to mount the container in leaktight manner on the airbrush. The bottom of the housing 36 may present a slope 70, e.g. of conical shape of angle $\alpha$ at the apex, which slope converges towards the composition-outlet orifice 35.

In the embodiment shown, the composition-taking channel 34 is coaxial about the longitudinal axis X of the container, the axis X also coinciding with the longitudinal axis of the housing 36. In variants that are not shown, the composition-taking channel 34 may be off-center relative to the longitudinal axis of the container 11 and/or to the longitudinal axis of the housing 36. In addition, in the embodiment shown, the composition-taking channel 34 is directed vertically downwards, but, in variants that are not shown, the channel 34 is not vertical and extends obliquely relative to the longitudinal axis of the container 11 and/or to the longitudinal axis of the housing 36.

An air-intake circuit is provided so as to enable air to enter into the container as said container empties, the container being closed except for the composition-taking and air-intake circuits.

In the embodiment shown in FIGS. 1 to 5, the air-intake circuit includes an air-intake channel 80 that opens out at one end into the bottom of the housing 36 via an orifice 81.

The top of the air-intake channel 80 communicates with an air-entry orifice 82.

The air-intake channel 80 may be formed of two segments 80*a* and 80*b*, as shown in the figures, namely a first segment 80*a* that is oriented perpendicularly to the longitudinal axis X, and a second segment 80*b* that extends parallel to the axis X, the second segment 80*b* advantageously being formed in the thickness of one of the uprights 40, as shown.

The air-entry orifice 82 may, as shown, be formed through the wall of the upright 40, which wall faces the container 11, the air-entry orifice 82 being formed by machining an annular groove in the facing faces of the uprights 40. The top of the air-intake channel 80 may be closed above the air-entry orifice 82 by a fitted stopper 84.

The segment 80*a* may extend a passage 86 that is used for making it, e.g. by machining or by molding, the passage 86 then being closed by a stopper 87.

In order to use the airbrush 2, the user places the container 11 on the junction device 30, for example.

Before putting the container 11 into place on the airbrush, its closure system 120 may be removed, for example.

When said junction device is pre-fastened on the airbrush 2, in order to avoid the composition flowing out of the container 11 while it is being inserted into the junction device 30, said airbrush is disposed upsidedown, the opening 90 of the container 11 being directed upwards, and then the container is pushed into the housing 36 until the collar 67 snap-fastens behind the gasket 60. The user may then turn the airbrush 2 over into its normal working position. The absence of a vent in the container avoids composition flowing out while the airbrush is not operating.

While the airbrush is not being used and compressed air is not flowing through the outlet duct (not shown) of the airbrush, the composition thus remains contained within the container 11 without flowing out, because of the suction existing above the level of the composition inside the container 11.

While the airbrush 2 is operating, the suction created at the composition outlet 35 causes the container to empty. Air is taken in via the air-intake channel 80.

Figure 6:
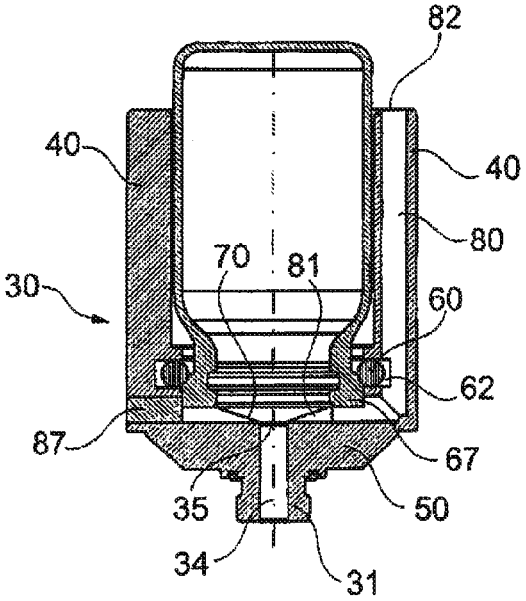
FIGS. 6 to 9 are views similar to FIG. 5 of variant embodiments of the junction device.
Figure 7:
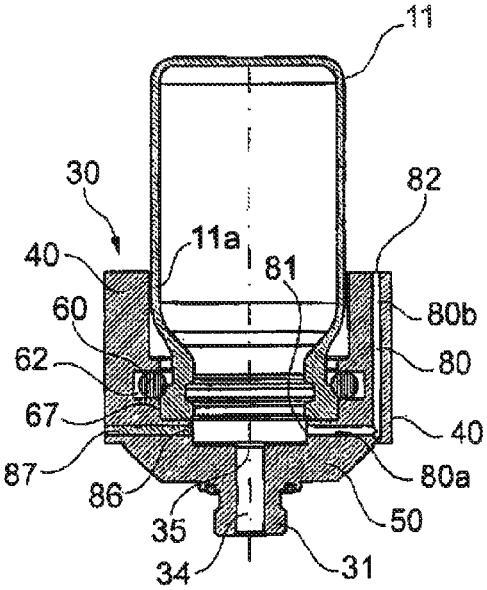

FIG. 6 shows a variant embodiment of the junction device 30 in which the air-entry orifice 82 opens out at the top end of the junction device 30. The same applies in the FIG. 7 embodiment. In this embodiment, the uprights 40 are shorter than the uprights in FIGS. 4 to 6.

Figure 8:
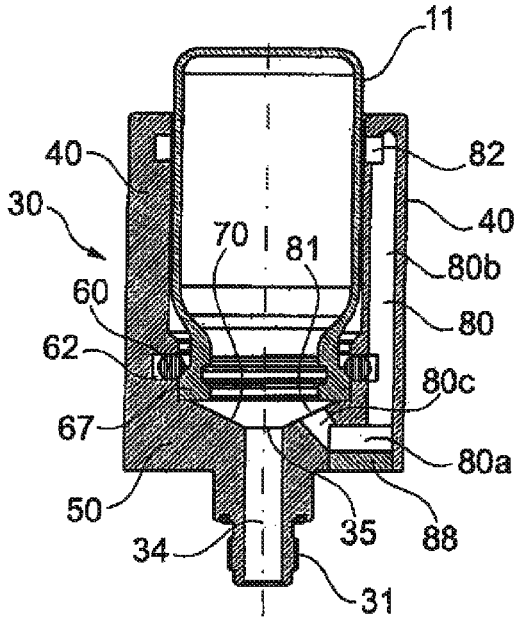

FIG. 8 shows another embodiment of the air-intake channel 80. In this embodiment, the channel includes a segment 80*b*, parallel to the axis X, that is connected via a segment 80*a* to a sloping segment 80*c* that opens out into the housing 36, the segments 80*b* and 80*c* being molded or machined in a portion of the junction device 30 that is made as a single part. A passage in the base 50 is used for forming the segments 80*b* and 80*c*, e.g. by machining or by molding. The passage is then closed, in part, by a separate stopper 88, and defines the portion 80*a*.

In the embodiments in FIGS. 1 to 8, the container 11 includes an opening that communicates with the airbrush via the junction device by removing the closure means 120 that are present on the body of the container 11 before it is put into place on the airbrush 2. By way of example, the closure means 120 are fastened by snap-fastening on the container 11.

In a variant embodiment of the invention, the junction device 30 includes perforator means that create openings through the closure means 120, in particular an opening that enables the composition to be taken, and an opening that enables air to be taken in. This is particularly advantageous for sealed bottles, e.g. bottles containing a composition that must not be exposed to air before use, or a composition that is particularly soiling.

Figure 9:
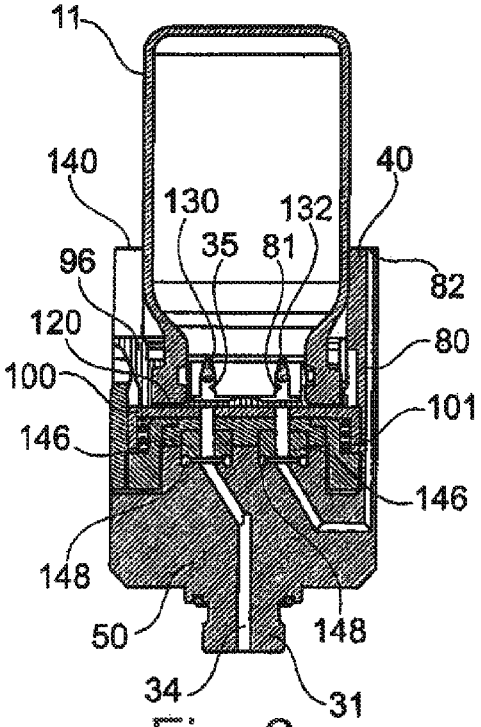
Figure 10:
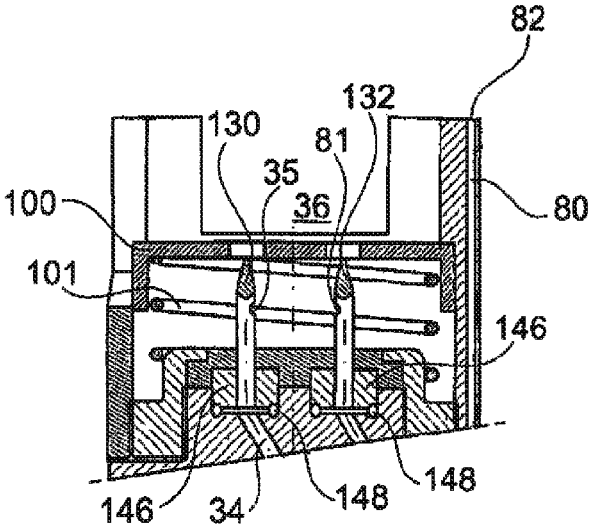
FIG. 10 is a diagrammatic and fragmentary larger-scale view of the FIG. 9 junction, with the container removed.

Thus, FIGS. 9 and 10 show an embodiment in which the airbrush 2 includes two perforator means, in this embodiment two hollow parallel needles 130 and 132, that perforate the closure means 120 of the container 11 when said container is put into place on the junction device 30. By way of example, and as shown, the two needles 130 and 132 present side openings that define the composition outlet 35 and the air inlet 81 respectively. The needles communicate with the composition-taking channel 34 and with the air-intake channel 80 respectively.

The needles 130 and 132 present an outside diameter that is compatible with the section of the orifices 35 and 81.

In order to ensure leaktight communication with the channels 34 and 80, the needles 130 and 132 may be inserted in leaktight manner in rings 146 having their bottom walls bearing against O-rings 148 in housings having the channels 34 and 80 opening out into their bottom walls.

In the embodiment shown, the needles 130 and 132 are approximately of the same height, which corresponds to a preferred embodiment. It is not beyond the ambit of the invention for the composition-taking needle 130 to be longer or shorter than the needle 132 connected to the air-intake channel 80.

So as to reduce the risk of injury to the user, a retractable protective member 100 may be disposed inside the housing 36, the protective member 100 being capable, in the absence of a container 11, of taking up a first position in which it extends above the ends of the needles 130 and 132, as shown in FIG. 10, and a lower second position, as shown in FIG. 9, when the container is put into place, so as to enable the needles 130 and 132 to pass through the closure means 120. The protective member 100 is returned into the first position by a spring 101.

By way of example, the upright 40 through which the air-intake channel passes is made integrally with the base 50, as shown. A groove 140 may be provided so as to pass a lug 96 of the closure means 120 while the container is being put into place in the housing 36.

In another embodiment that is not shown, all of the uprights 40 are made as a single part that is fitted on the base 50. Naturally, other configurations are possible.

Figure 13:
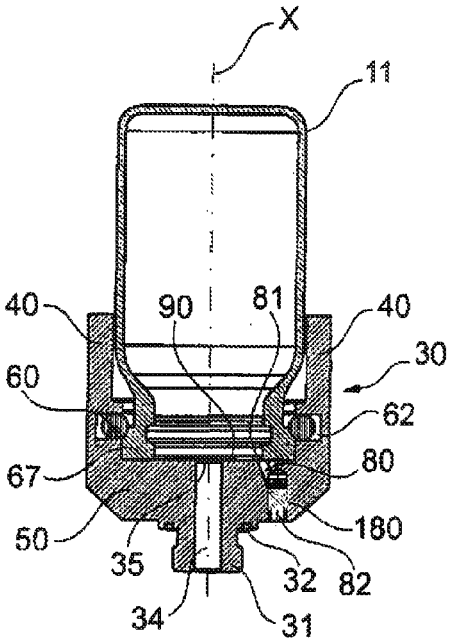
FIG. 13 is a view similar to FIG. 5 showing a variant embodiment in accordance with other exemplary embodiments of the invention.

In the embodiment shown in FIG. 13, the air-entry orifice 82 is situated below the base 50. In order to avoid composition leaking, e.g. during manipulations of the container, the air-intake channel 80 may thus include a valve 180, as shown, e.g. a ball valve. The FIG. 13 embodiment serves to illustrate the other exemplary embodiments of the invention that rely on the use of the annular gasket 60, so as to show clearly that these exemplary embodiments of the invention are independent of positioning of the air entry 82 above the air inlet 81.

The airbrush 2 may include any trigger means for triggering spraying, e.g. in the form of a control member such as a lever 13, as shown in FIG. 14, that is actuated using one of the fingers of the user's hand that is holding the airbrush. In FIG. 14, the airbrush is a gravity airbrush. It is not beyond the ambit of the invention for a suction feed airbrush to be used. For a suction feed airbrush, it suffices for the junction device 30 to be provided with a system (e.g. a tube 200 as shown by dashed lines in FIG. 1) for putting the outlet orifice 35 into communication with the inlet of the airbrush, thereby enabling suction.

Examples of airbrushes to which the invention may apply and that may be mentioned are the airbrush referenced A 4700 from the supplier Azteck, the airbrush referenced Kustom micron CM from the supplier Iwata, and the airbrush referenced Evolution Infiniti 2 in 1 from the supplier Harder and Steenbeck, those airbrushes being of the type held like a pen. The airbrush referenced Kustom revolution TR from Iwata, or the airbrush referenced Colani® from Harder and Steenbeck may equally well be used.

Naturally, configurations other than the configurations described above are possible. For example, a single compressor may be used with a plurality of airbrushes, e.g. the compressor being situated outside the room in which the treatment is performed so as to reduce noise nuisance.

Preferably, the spray is circular, but various nozzles may be used so as to have sprays that are flat or that have some other shape.

The compressor may be replaced by a supply of compressed air, e.g. compressed air in a cylinder, or a cartridge of compressed or liquefied gas, e.g. carried on the airbrush and manipulated together with said airbrush during use.

A plurality of containers may be mounted on the airbrush, where appropriate.

The expression "comprising a" should be understood as being synonymous with "comprising at least one" unless specified to the contrary.

The invention claimed is:

1. A junction device for a gravity-fed spray system, the device being arranged so as to connect, to an airbrush, at least one removable container containing a composition for spraying, the device comprising:

at least a composition-outlet first orifice enabling the composition to leave the container in order to be sprayed via the airbrush;

at least an air-inlet second orifice in the container enabling air intake by the container; and an air-intake channel connected to the air-inlet orifice, the channel terminating by an air-entry orifice situated above the air-inlet orifice and the composition-outlet orifice during use, the air inlet orifice opening out onto a vertical inside wall of the junction device.

2. The device according to claim 1, further comprising an upwardly-open housing in which the container is engaged, at least in part, when the device is in place on the airbrush.

3. The device according to claim 1, further comprising a sealing gasket providing leaktight fastening of the container on the junction device.

4. The device according to claim 1, wherein the air-intake channel is situated, over at least a fraction of its length, in the thickness of a wall of an upright of the junction device.

5. The device according to claim 1, further comprising a gasket, preferably an O ring, disposed so as to be able to snap-fasten on a collar of the container, the gasket being configured to seal the container and fasten the container.

6. The device according to claim 1, further comprising one or more uprights not surrounding the container completely over its entire height.

7. The device according to claim 1, further comprising a perforator means respectively including the composition-outlet orifice and the air-inlet orifice.

8. The device according to claim 1, wherein the junction device does not include any endpiece or other element that is capable of engaging in an opening of the container when the container is in place.

9. The device according to claim 8, wherein the container is received in a housing that presents a slope that defines a conical section that converges towards the composition-outlet orifice.

10. A gravity-fed airbrush system comprising:

an airbrush; and the junction device according to claim 1.

11. The airbrush system according to claim 10, associated with one or more removable and interchangeable containers, each containing a composition for spraying, the container(s), being for fastening on the junction device.

12. The airbrush system according to claim 10, wherein the air-inlet orifice is situated above a maximum level, in the container, of composition for spraying.

13. The airbrush system according to claim 10, wherein the composition-outlet orifice is disposed coaxially about a longitudinal axis of the container.

14. A gravity-fed airbrush system comprising:

an airbrush;

at least one removable container containing a composition for spraying, and preferably being in the form of a bottle, with a neck provided with a collar; and a junction device including:

at least one housing for receiving at least the container; and an annular gasket disposed so as to snap-fasten and to bear in leaktight manner on the container when the container is in place in the housing.

15. The airbrush system according to claim 10, wherein the airbrush is a gravity airbrush.

16. The airbrush system according to claim 10, wherein the airbrush is a suction feed airbrush and the junction device is provided with a communication system between the composition-outlet orifice and the inlet of the airbrush, thereby enabling suction.

17. A spraying method comprising spraying a composition by means of a gravity-fed system according to claim 10, the composition being selected from the group consisting of art paint, industrial paint, a composition for treating wood, an industrial cleaning composition, a dye for textiles, a food coloring, a composition for treating leather, and a cosmetic composition.

18. The device according to claim 5, wherein the gasket is an O-ring.

19. The device according to claim 7, wherein the perforator means is needles.

20. A junction device for a gravity-fed spray system, the device being arranged so as to connect, to an airbrush, at least one removable container containing a composition for spraying, the device comprising:

at least a composition-outlet first orifice enabling the composition to leave the container in order to be sprayed via the airbrush;

at least an air-inlet second orifice in the container enabling air intake by the container; and an air-intake channel connected to the air-inlet orifice, the channel terminating by an air-entry orifice situated above the air-inlet orifice and the composition-outlet orifice during use, the air inlet orifice opening out onto a vertical inside wall of the junction device, the junction device not including any end piece or other element being capable of getting in an opening of the container once the container is in place.

21. The device according to claim 20, wherein the container is received in a housing that presents a slope that defines a conical section that converges towards the composition outlet orifice.

22. A junction device for a gravity-fed spray system, the device being arranged so as to connect, to an airbrush, at least one removable container containing a composition for spraying, the device comprising:

at least a composition-outlet first orifice enabling the composition to leave the container in order to be sprayed via the airbrush;

at least an air-inlet second orifice in the container enabling air intake by the container; and an air-intake channel connected to the air-inlet orifice, the air-intake channel terminating by an air-entry orifice situated above the air-inlet orifice and the composition-outlet orifice during use, the air-intake channel being situated, over at least a fraction of its length, in the thickness of a wall of an upright of the junction device.

23. A junction device for a gravity-fed spray system, the device being arranged so as to connect, to an airbrush, at least one removable container containing a composition for spraying, the device comprising:

at least a composition-outlet first orifice enabling the composition to leave the container in order to be sprayed via the airbrush;

at least an air-inlet second orifice in the container enabling air intake by the container; and an air-intake channel connected to the air-inlet orifice, the air-intake channel terminating by an air-entry orifice situated above the air-inlet orifice and the composition-outlet orifice during use, the junction device including one or more uprights that do not surround the container completely over its entire height.

* * * * *